US006352160B1

(12) United States Patent
Harden

(10) Patent No.: US 6,352,160 B1
(45) Date of Patent: Mar. 5, 2002

(54) SYSTEM AND METHOD FOR CAPTURING FERROUS ARTICLES FROM FOOD WASTE SYSTEMS

(76) Inventor: Rowland S. Harden, 9202 E. Pioneer, Parker, CO (US) 80138-6222

( * ) Notice: Subject to any disclaimer, the term of this patent is extended or adjusted under 35 U.S.C. 154(b) by 0 days.

(21) Appl. No.: 09/578,320

(22) Filed: May 24, 2000

(51) Int. Cl.[7] ..... B07C 5/344
(52) U.S. Cl. ..... 209/636; 209/926
(58) Field of Search ..... 209/606, 636, 209/212, 213, 214, 216, 223.1, 231, 926

(56) References Cited

U.S. PATENT DOCUMENTS 3,486,393 A * 12/1969 Maxwell ..... 74/424.8
3,809,239 A 5/1974 Barrett et al.
3,926,792 A 12/1975 Buford
4,367,138 A 1/1983 Kustas
4,494,657 A 1/1985 Oldenkamp
4,706,818 A 11/1987 Zutell et al.
4,717,469 A * 1/1988 Pire ..... 209/8
4,744,469 A 5/1988 Swallert
4,754,882 A 7/1988 Petitpierre
4,782,970 A 11/1988 Edwards
6,129,213 A * 10/2000 Edwards ..... 209/214

* cited by examiner

*Primary Examiner*—Donald P. Walsh
*Assistant Examiner*—Mark J. Beauchaine
(74) *Attorney, Agent, or Firm*—Ramon L. Pizarro; Edwin H. Crabtree

(57) ABSTRACT

A system for removing ferrous materials from a flow of non-ferrous materials, the flow being defined by a duct having sides to confine the flow of non ferrous materials along a flow path axis. The system includes an enclosure having sides, at least one side of the enclosure being adapted for mounting against the sides of the duct. At least two magnets are mounted within the enclosure, the magnets being retained within the enclosure and spaced apart from one another within the enclosure, and a piece of ferrous material extending between the magnets to provide a flow path for the magnetic flux between the magnets, so that the magnetic flux is focused along an axis extending between the magnets. An attachment mechanism for supporting the enclosure together with the magnets against the sides of the duct is also provided, so that the axis of focus of magnetic flux extends at an angle to the flow of non-ferrous material when the enclosure is supported against the side of the duct.

7 Claims, 3 Drawing Sheets

SYSTEM AND METHOD FOR CAPTURING FERROUS ARTICLES FROM FOOD WASTE SYSTEMS

BACKGROUND OF THE INVENTION (a) Field of the Invention

This invention generally relates to a system and method for capturing ferrous objects that are being carried by a flow of material, such as a flow of food waste along a trough. More particularly, but not by way of limitation, to system that and method that uses static focused magnets to pull and retain ferrous items, such as silverware, at a location over the flow of food waste.

(b) Discussion of Known Art

In the food service industry it is common practice to clean and sanitize a large number of dishes or trays that contain waste food scraps in a short period of time. To achieve this task, common practice in the industry provides for an assembly line type of arrangement, where trays or dishes are first cleared of waste food materials and then placed on conveyors or carrying racks that transport the dishes, flatware, and trays, into a large capacity washing installation.

The waste food products removed from the dishes or trays are collected in a trough or duct that is used to carry these waste products to a device, such as a grinder or disposer, that grinds the waste materials, so that it may then be easily washed into the sewage system of the restaurant, cafeteria, or other food service institution. The grinding or disposal equipment used in these applications is designed for grinding relatively soft material, and, consequently, is vulnerable to serious damage in the event that flatware, or other items that include ferrous components, falls into the grinding equipment.

It is well known that magnets may be used to pull ferrous items from the flow of waste food being delivered to the grinder or disposer. For example U.S. Pat. No. 4,706,818 to Zutell et al. teaches a magnetic system that is installed along the flow path of the waste products in order to ensure contact of the magnets used with the system and flatware that is being carried in the waste materials being carried into the grinder.

Another example is found in U.S. Pat. No. 3,926,792 to Buford. Buford teaches the placement of magnets behind a conveyor belt to attract ferrous objects being carried on or next to the belt. This solution however is limited in scope. This limited solution is particularly useful in applications that use conveyor belts, but provides little guidance for an application that uses a trough that carries a mixture of water and waste food.

Yet another device that uses magnets to remove metal from waste food products is shown in U.S. Pat. No. 4,744,469 to Swallert. The Swallert system teaches the use of magnets in conveyor type systems, but give little guidance as how to solve the problem of removing ferrous objects, such as flatware, from a flow of material as is found in a trough carrying water and waste material into a grinding device.

Still another device that addresses the removal of flatware form a conveyor system is taught in U.S. Pat. No. 3,486,939 to Pinckard. The Pinckard device, like the Swallert device is particularly useful for removing flatware and other ferrous objects from a conveyor belt, but does little to address the problems associated with removing these types of items from a moving flow of material.

Therefore, a review of known devices reveals that there remains a need for a system that can be used to remove flatware or other ferrous objects from a moving flow of material that is carrying the flatware.

Still further, there remains a need for a system that can be used to modify existing flow based waste carrying systems, without having to modify extensively the existing trough or arrangement used to wash the waste products towards a grinding or disposal system.

SUMMARY

It has been discovered that the problems left unanswered by known art can be solved by providing a stationary, focused magnetic field that is focused at a location over the main flow of food waste. In a preferred embodiment, the magnetic field has been focused such that the highest density of magnetic flux is along a direction that is transverse to the flow of food waste, and at a distance away from the flow.

It has been discovered that by providing this focused magnetic flux at a distance over the flow of waste food, one can cause ferrous items such as silverware to be pulled from the flow and suspended by way of the magnetic field along a volume where the magnetic flux is at its highest density. Thus, by focusing the magnetic field so that strongest area of flow is along an area away from the main flow of waste food and generally on a different plane from the flow of waste food.

In a highly preferred embodiment of the invention, the focused magnetic field is generated by providing a magnet assembly that includes at least two magnets separated by a non-magnetic spacer, and joined by a ferrous plate that concentrates and facilitates the magnetic flux from one magnet to the other. The entire assembly is held within an enclosure that allows mounting of the assembly at a desired location relative to the flow of waste food. For example, in an application where the flow of waste food is defined by a trough, and in most institutional applications this trough is made of stainless steel, which is non-magnetic, the enclosures disclosed herein are positioned against the sides of the trough. The enclosures will be positioned such that the focused region of magnetic flux emanating from the enclosure flows along a plane that is generally parallel to the flow of waste food. Most preferably, this flux will be at an angle that lies along a plane that is parallel to the flow of the waste food.

In a highly preferred embodiment, the enclosures are positioned at a location along the trough, on opposite sides of the trough, with the region of concentrated flux lying along a line over the flow of waste food. The presence of the two magnetic fields pulling in opposite directions from one another ensures that ferrous items, such as silverware, is pulled from the flow of waste food and suspended over the flow of waste food in an orientation that is generally aligned with the line or axis extending between the two enclosures.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1A:
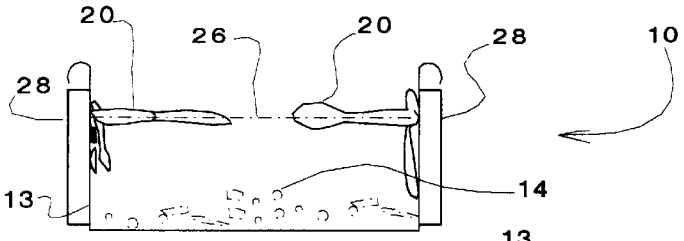
FIG. 1A is an end view looking into a duct or trough, the view illustrating the coaxial positioning of the axis of focus of the magnet arrangements held within the casings that are mounted on opposite sides of the duct or trough.
Figure 1:
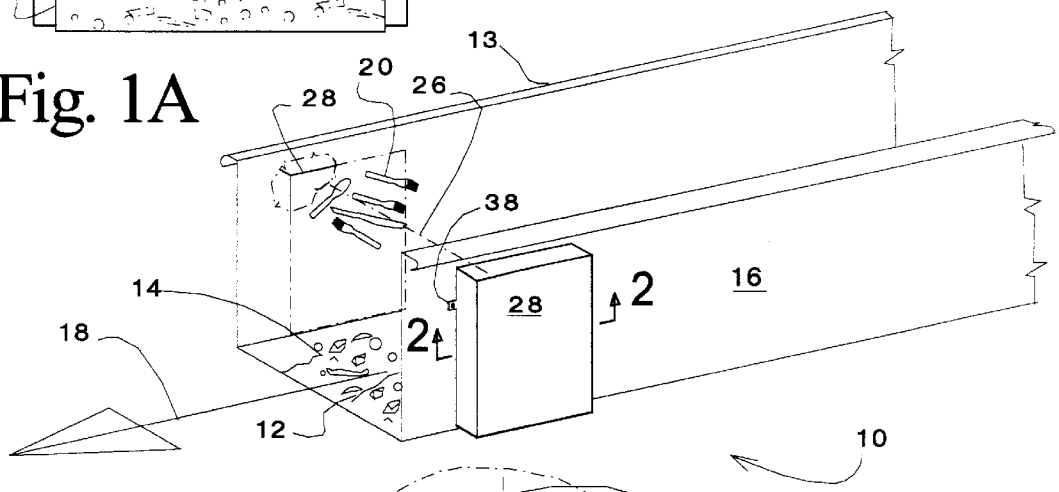
FIG. 1 is a perspective view of an embodiment of the invention in use on opposite sides of a trough carrying waste food materials.

Turning now to FIG. 1 where a highly preferred embodiment of a system 10 for removing ferrous materials, such as flatware, from a flow 12 of non-ferrous materials 14, such as food waste or food scraps. The flow 12 is constrained or defined by a duct 13, which in the illustrated example is a trough such as the commonly used stainless steel trough found in many food service or institutional food service applications.

Turning now to FIGS. 1 and 1A, it will be understood that the duct 13 will define the flow 12 by restraining the flow within sides 16 of the duct 13. In a food service application, the flow 12 will often consist of food scraps that have been gathered during dishwashing operations. Thus, it is highly probable that items of flatware 20 will have inadvertently found its way into the flow 12.

The flow 12 moves along the duct 13 along a flow path axis 18, shown on FIG. 1, carrying with it the non-ferrous waste food materials, as well as items of flatware 20. To remove the items of flatware, without interrupting the flow 12, and while ensuring that the system for removing the flatware 20 is effective and reliable, at least two magnets, or magnet assemblies 22, that provide a magnetic flux 24 or field are placed against the sides 16 of the duct 13. It is important to note that it is contemplated that the disclosed magnet assemblies may be positioned over the duct 13, supported by a bridge type structure. However, it is a well-known fact that the strength of a magnetic field attenuates at a rate the cube of the distance from the source. Therefore, to ensure the effectiveness of the disclosed system, magnets are positioned on opposite sides 16 of the duct 13.

Figure 2:
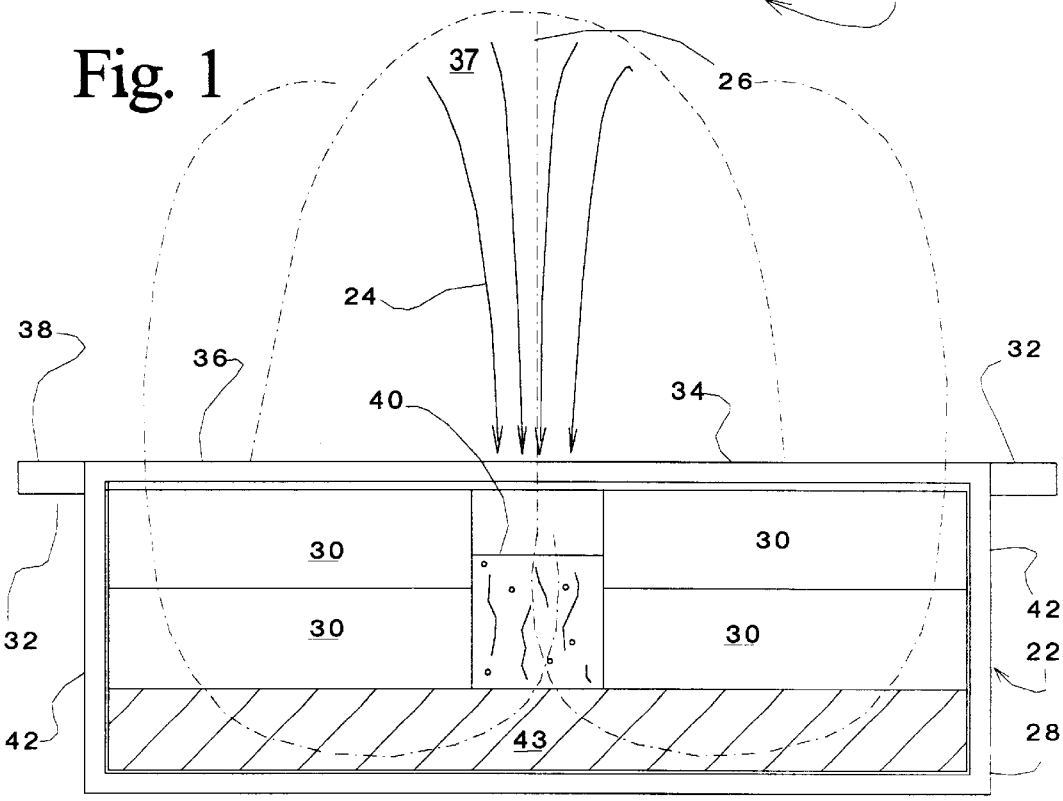
FIG. 2 is a section taken at the location indicated on FIG. 1, and in the direction indicated by the section arrows.

Turning now to FIG. 2, it will be understood that in a highly preferred embodiment of the invention the magnetic field or flux is provided by an arrangement that focuses the magnetic flux 24 along an axis 26. Arranging a plurality of magnets 30 within an enclosure 28 creates the focused flux. The enclosure 28 includes mounting connectors or brackets 32 that are used to attach the enclosure 28 to the sides 16 of the duct 13.

As shown on FIG. 2, the magnets 30 are held within the enclosure 28 in a spaced apart arrangement. Additionally, at least one piece of magnetically conductive or ferrous material, preferably in the shape of a plate 43 extends between the magnets 30 to provide a flow path for the magnetic flux between the magnets 30. It has been found that retaining the mag nets 30 in this arrangement produces a focusing or concentration of magnetic flux provided by the individual magnets to create an area 37 of concentrated magnetic flux generally focused along the axis 26, which in the illustrated example, extends between the magnets 30.

Turning once again to FIGS. 1 and 1A, it will be understood that in a preferred example, once the enclosures 28 have been fastened against the sides 16 of the duct, the preferred positioning of the enclosures 28 creates an arrangement where axis 26 of the flux extends at an angle to the flow 12 of non-ferrous material 14. Most preferably, the axis 26 and the flow path axis 18 will be in separate planes. Most preferably, a pair of enclosures will be attached on opposite sides 16 of the duct 13 in a manner that will cause the axis of flux 26 emanating from one enclosure to extend in a generally coaxial manner with the axis of flux 26 emanating from the enclosure mounted on the opposite side 16.

It has been discovered that the arrangement illustrated in FIGS. 1 and 1A does away with the reduction in effectiveness caused by the attenuation of the magnetic field across the duct 13. The preservation of effectiveness is carried out in large part by the focusing of the magnets 30, and, further, due to the facts that in this application the magnets 30 cooperate with one another to pull ferrous materials from the flow 12, and suspend or retain these articles along a planar region over the plane of the flow 12. Importantly, in the application illustrated in FIGS. 1 and 1A, will align the axis or body of the flatware 20 with the axis of flux 26, which will lie along a plane that extends over the flow of non-ferrous materials 14.

Turning to FIG. 2, it will be understood that in a preferred example, the enclosure 28 includes a front side 34, which includes a front panel 36 and fastener supports 38, which can be in the form of brackets 32, next to the front panel 36. These fastener supports 38 are used to mount the enclosure 28 against the sides 16 of the duct or over a bridge type support or the entrance of a disposal device, as will be discussed in conjunction with FIG. 3. Fastener supports 38 are needed due to the fact that most ducts for transporting waste food materials in the food service industry are made of non-magnetic, or mildly magnetic, materials such as high nickel content stainless steel. It is important to note that while a preferred example of the invention mounts directly to the sides of the trough, it is contemplated that an external support, such as a floor stand or ceiling mounted post or beam, may also be used to hold the enclosures at an optimal position along the trough or duct 13.

As shown on FIG. 2, the magnets 30 are held or supported by the enclosure 28 in a spaced apart relationship. In the illustrated example, a spacer 40 made from a dielectric or non-magnetic material defines this spacing. Of course, it is contemplated that various other retainers or supports may be used to maintain this spacing between the magnets 30. For example, it is contemplated that integral ribs or protrusions may extend from the front panel 36 to keep the magnets 30 at the desired locations within the enclosures 28.

Thus, the system 10, as used in FIGS. 1 and 1A will include a second enclosure, preferably being of the same construction as the enclosure 28, and thus having sides 42. At least one side of the second enclosure also being adapted for mounting against the sides of the duct 13, and holding at least two magnets 30 that will provide magnetic flux, preferably in a focused manner to reduce the size and strength of the magnets used.

Also illustrated in FIG.2, is that a piece of ferrous material 43, such as a piece of mild steel, that extends between the magnets 30 is used to provide a flow path for the magnetic flux between the magnets 30. This flow path allows the magnetic flux 24 to be focused or concentrated along the axis 26, which will extend between the magnets 30. Preferably, the second enclosure, together with its magnets 30, will be held against the sides 16 of the duct 13, so that the axis of focus of magnetic flux 26 extends at an angle to the flow of non-ferrous material 14 as the second enclosure is supported against the side 16 of the duct 13.

Figure 3:
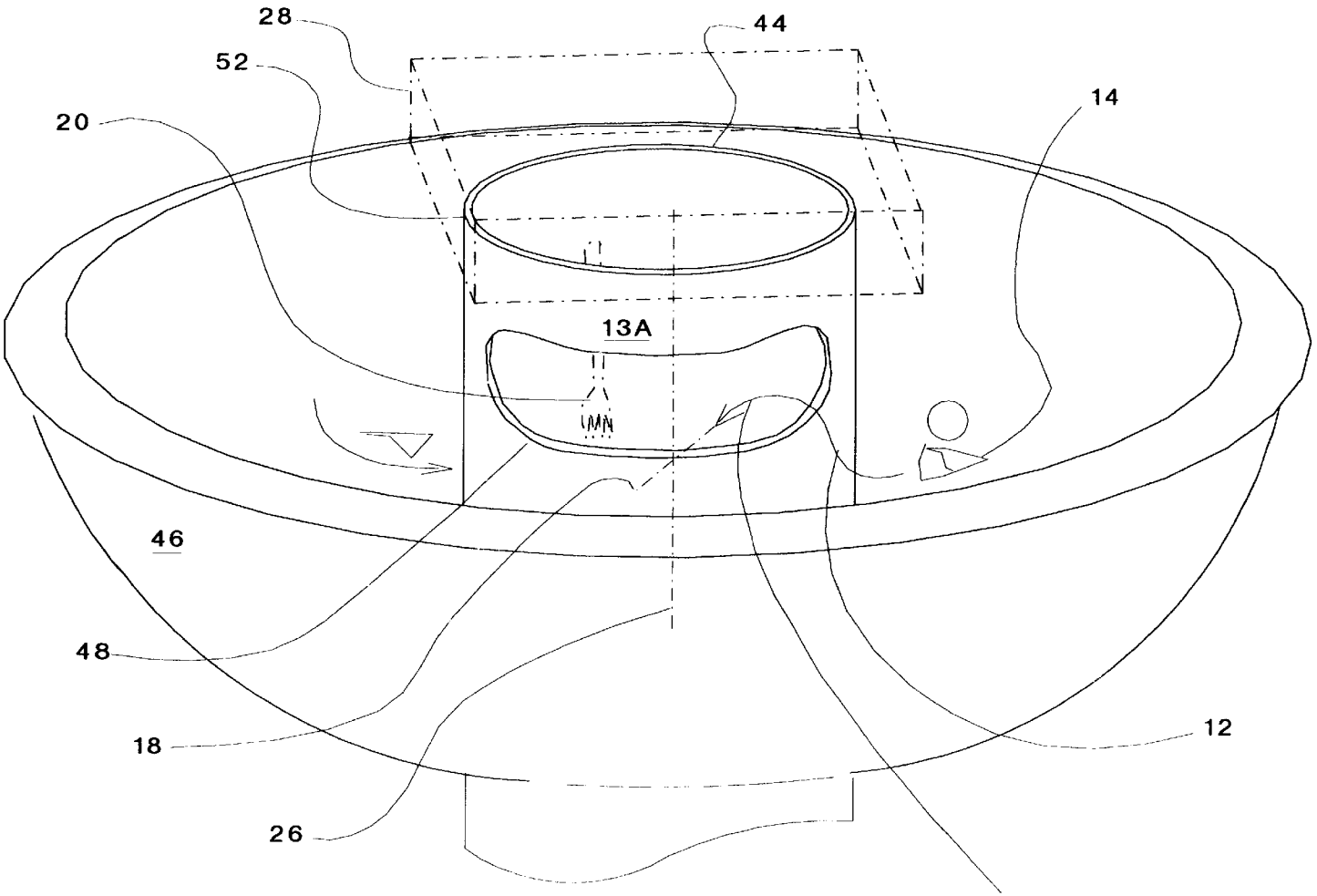
FIG. 3 is a perspective view illustrating the use of the disclosed magnet arrangement over the cylindrical intake on a disposer bowl.

Turning now to FIG. 3 it will be understood that the disclosed system may be used to capture or retrieve flatware 20 from a duct or entryway 44 that leads from a sink 46 into a waste grinder or disposer. The entryway 44 includes a side aperture 48 that is found at a distance over the bottom of the sink 46. In this application, the flow 12 of non-ferrous materials 14, typically waste food products flows in the direction of arrow 50 into the side aperture 48. Thus arrow 50 represents the flow path axis for this application. The enclosure 28 is thus placed over the top portion 52 of the duct 13A, positioning the axis of flux 26 at an angle to the flow of non-ferrous material 14. Thus, the flow in this application enters the duct 13A and immediately proceeds down towards the disposer or grinder along a plane that is generally parallel to the axis of flux 26.

Figure 4:
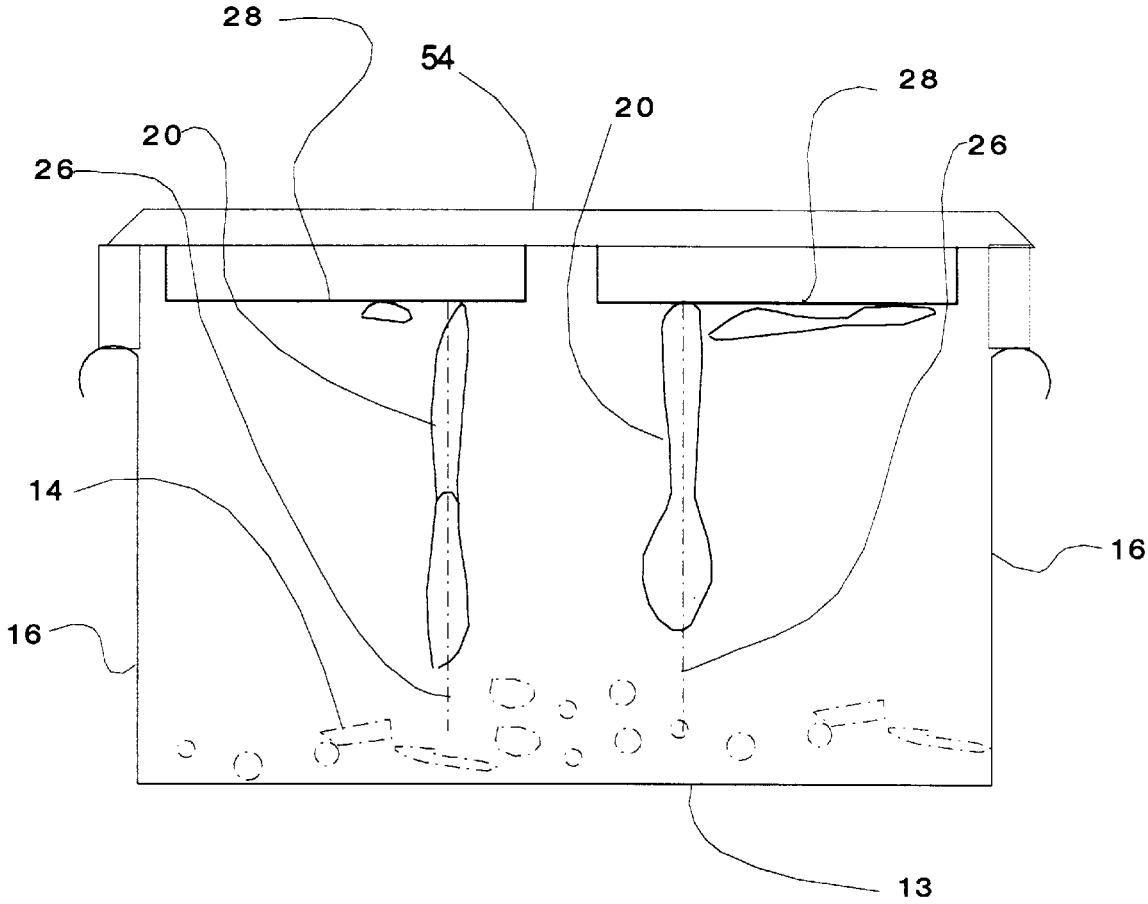
FIG. 4 is an end view similar to FIG. 1A, illustrating the use of the magnets disclosed herein while suspended from a bridge type support across the duct.

Thus, it will be appreciated that the disclosed system 10 can be applied in a variety of forms without departing from the true scope and spirit of the disclosed invention. For example, in FIG. 4 a bridge 54 is used to support the enclosure 28 over the flow 12. However, this installation suffers from the attenuation problems discussed above.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A system for removing ferrous materials from a flow of non-ferrous materials, the flow being defined by a duct having a pair of generally parallel sides and a bottom, the duct confining the flow of non-ferrous materials along a flow path axis, the system comprising:

a pair of enclosures having sides, at least one side of the enclosure being adapted for mounting against the sides of the duct;

each enclosure containing at least two magnets that provide magnetic flux, the magnets being mounted within said enclosure, said magnets being retained within said enclosure and spaced apart from one another, and a piece of ferrous material extending between the magnets to provide a flow path for the magnetic flux between the magnets, so that the magnetic flux is focused along an axis extending between the magnets;

means for supporting the enclosures together with said magnets against opposite sides of the duct, so that the axis of focus of magnetic flux from each enclosure extends in a generally coaxial manner from the opposite sides of the duct and at an angle to the flow of non-ferrous material when the enclosures are supported from opposite sides of the duct.

2. A system according to claim 1 wherein said magnets are held apart from one another by a spacer.

3. A system according to claim 2 wherein said enclosures are supported at a distance from the bottom of said duct, so that the axis of focus of magnetic flux from each of said enclosures is generally parallel to the bottom of said duct.

4. A system according to claim 3 wherein said enclosures have been adapted for attachment directly to the sides of the duct.

5. A method for removing ferrous objects from a flow of non-ferrous material, the flow being confined to a duct having sides defining a flow path along a flow path axis, the method comprising:

providing at least two sources of magnetic flux, the flux having an area of greater flux density oriented along an axis;

supporting the sources of magnetic flux next to the duct and spaced apart from one another with the axis of the area of greater flux density of the sources of magnetic flux density being approximately coaxial and extending towards one another; and positioning the sources of magnetic flux such that the axes of the area of greater flux density extend over and at an angle to the axis of the flow path such that the axis of the area of greater flux and the axis of the flow path do not intersect, so that ferrous items found in the flow of nonferrous material is pulled from the flow of non-ferrous material and aligned with the axis of the area of greater flux density, so that the ferrous material is held away from the flow of non-ferrous material.

6. A method according to claim 5 and further comprising positioning the axis of the area of greater flux density at a distance over any non-ferrous materials flowing through the duct.

7. A method according to claim 6 and further comprising removing the ferrous material from the axis of the area of greater flux density.

* * * * *